United States Patent [19]

Mancini

[11] Patent Number: 4,913,058

[45] Date of Patent: Apr. 3, 1990

[54] CONTINUOUS BALLAST-TAMPING MACHINE WITH INDEPENDENT TAMPING HEADS FOR RAILWAY LINES

[75] Inventor: Flavio Mancini, Brescia, Italy

[73] Assignees: ITI/CLM Impianti Tecnici Industriali; Danieli & C. Officine Meccaniche SpA, both of Buttrio, Italy

[21] Appl. No.: 259,806

[22] Filed: Oct. 19, 1988

[30] Foreign Application Priority Data

Nov. 3, 1987 [IT] Italy ..... 83484 A/87

[51] Int. Cl.[4] ..... F01B 27/12

[52] U.S. Cl. ..... 104/12

[58] Field of Search ..... 104/2, 10, 12

[56] References Cited

U.S. PATENT DOCUMENTS

| | | | |
|---|---|---|---|
| 4,369,712 | 1/1983 | von Beckmann . | |
| 4,404,913 | 9/1983 | Theurer | 104/12 |
| 4,576,095 | 3/1986 | Theurer | 104/12 |
| 4,627,358 | 12/1986 | Theurer | 104/12 X |
| 4,628,822 | 12/1986 | Theurer | 104/12 X |
| 4,635,557 | 1/1987 | Mohr et al. | 104/12 X |
| 4,644,868 | 2/1987 | Theurer et al. | 104/12 X |
| 4,773,333 | 9/1988 | Theurer | 104/12 |

FOREIGN PATENT DOCUMENTS

| | | |
|---|---|---|
| 2424829 | 1/1976 | Fed. Rep. of Germany . |
| 2148361 | 5/1985 | United Kingdom . |

OTHER PUBLICATIONS

"The Jackson track Maintainer", 9/1954.

*Primary Examiner*—Margaret A. Focarino
*Assistant Examiner*—Gary C. Hoge
*Attorney, Agent, or Firm*—Wegner & Bretschneider

[57] ABSTRACT

Continuous ballast-tamping machine having a machine structure able to run with a straight, uniform motion along a railroad line and having a tamping structure connected thereto able to move lengthwise along the machine structure with a straight, alternating movement owing to the action of an actuation means. The tamping structure is adapted to consolidate ballast in correspondence with sleepers that bear the railway line. The tamping structure has a plurality of tamping heads each of which has a tine holder, and each tine holder is positionable vertically in an independent manner in relation to the railway line. Independent means are included for providing vibratory motion for each pair of tamping heads.

7 Claims, 2 Drawing Sheets

CONTINUOUS BALLAST-TAMPING MACHINE WITH INDEPENDENT TAMPING HEADS FOR RAILWAY LINES

BACKGROUND OF THE INVENTION

This invention concerns a continuous ballast-tamping machine with independent tamping heads for railway lines.

To be more exact, the invention concerns a ballast-tamping machine able to run with a uniform motion on a railway line to be tamped; the tamping unit of the machine is provided with horizontal alternating motion and comprises tamping tine-holder heads capable of vertical movement independently of each other.

Such heads impart a vertical alternating motion to the tine-holders, and to the tamping times connected thereto, independently of each other on each quadrant of the rail/sleeper attachment.

The machine obtains thereby a much lighter general structure and great working flexibility with regard to equipment included in the railway line, such as switches and crossings, and various obstacles, such as double sleepers and the like.

The state of the art covers ballast-tamping machines which work on railway lines with various operating methods.

Some machines work discontinuously and halt at each sleeper or group of sleepers where tamping is to be performed.

Other machines work continuously; the tamping units on them are halted momentarily in correspondence with the sleepers while the machine continues its movement along the line.

The machines which work continuously are more productive and provide different concepts regarding the embodiment of the units performing the tamping work but are more complex and, above all, have greater dimensions and heavier weights than the machines which work discontinuously.

There are also continuous machines in which the main motive vehicle incorporates a bogie, or satellite vehicle, that bears the tamping units, the bogie being equipped with its own means for running on the railway line.

The bogie moves with an alternating motion in relation to the main vehicle and comprises bodies of a great size, this being required to impart to the tamping units the necessary force and energy for penetration into the ballast.

These great bodies have an unfavourable effect on the evenness of the movement of the motive vehicle when the latter has to transmit motion mechanically to the satellite vehicle.

Continuous machines have also been designed which comprise tamping units that are closely anchored in a vertical direction to the structure of the motive vehicle and can run horizontally on that vehicle.

Such machines entail generally a lighter overall structure than the types having a satellite vehicle and comprise parts cooperating with much smaller bodies engaged in a horizontal alternating motion.

Such smaller bodies enable the ballast-tamping machine to work more evenly, but there are still grave structural problems regarding absorption of the tamping stresses.

A machine of this type is disclosed, for instance, in DE 1067837.

GB 2,148,361 discloses tamping heads which can move vertically and are contained in one single body, that is to say, they are not independent of each other as regards positioning or adjustment. The one single independent movement of the tools is obtained to avoid contact with the rails when there are double lines or switches.

US 4,369,712 discloses tamping means in one single body of several tamping heads with tine-holders fixed to the body, the body being adjustable as one overall whole and not as regards the individual heads. The independent action of the individual groups of heads is obtained by groups on the same side of the line.

The continuous machines of the state of the art have very complex and heavy tamping structures that bear and move the tines working on the ballast since the vertical alternating motion is imparted to the whole operating unit including the structure, the vibration system and the system for extending and retracting the tine-holders.

Such tamping structures, whether they are provided with a pendular, oscillatory motion or a horizontal, alternating motion, are moved, in any event, vertically together with the tine-holders and tines during the path of approach and insertion of the tines into the ballast.

This entails the vertical movement of heavy bodies and unfavourable structural repercussions from a structural and functional viewpoint.

Moreover, when they coincide with the equipment of the railway line, such as switches and crossings, or various obstacles, such as double sleepers and the like, these tamping structures may include complex systems for the temporary withdrawal of some of the tines from their working position, the tines being caused to rotate about a horizontal axis, for instance.

Cases may sometimes occur when the tamping work on the railway line is completely stopped.

SUMMARY OF THE INVENTION

The present applicants have the purpose of providing a continuous ballast-tamping machine having a simplified overall structure with masses of a limited size in alternating motion, the machine being capable of overcoming the other problems of the prior art as described above.

This purpose is achieved by employing a tamping structure with independent heads.

Such tamping structure is closely anchored in the vertical and transverse directions to the structure of the motive vehicle, as in the state of the art.

The tamping structure, which moves along the direction of the railway line on horizontal guides with an alternating motion and a substantially step-by-step movement in relation to the motive vehicle, comprises independently actuated tamping heads.

The tamping heads consist of an element which supports and guides a tine-holder able to slide vertically within such element, the element being connected to the tamping structure.

The tine-holder bears at its end at least one tine solidly fixed to the holder and acting on the metalling in correspondence with the sleeper of the railway line.

The tine-holders and therefore the tines connected thereto are moved vertically by the action of a drive means, which is advantageously a jack, until they are inserted within the metalling in the required position.

The element which supports and guides the tine-holder cooperates with a vibration unit intended to impart the required frequency and amplitude of vibration to the tine at work.

This support and guide element cooperates also with a tine projection and retraction unit, which is advantageously a jack and has the task of displacing the tine lengthwise towards a sleeper of the railway line and also away therefrom.

Each tamping head described above works during tamping operations in coordination with an equivalent head positioned as a counterpart to the former head on the other side of the sleeper.

Several pairs of heads positioned as counterparts of each other astride the sleeper can work in parallel about the same sleeper.

Likewise, several pairs of heads can work in series on neighbouring sleepers.

The invention enables a vertical alternating motion of bodies of a limited size (tines and tine-holders) to be obtained.

The independent nature of the vertical actuation systems of each tamping head makes it possible to operate in a required manner in the presence of any obstacle or equipment on the line encountered during travelling by merely actuating the heads capable of operating materially and efficiently.

The invention is therefore embodied according to the contents of claim 1 and the dependent claims.

BRIEF DESCRIPTION OF THE DRAWINGS

The attached figures, which are given as a non-restrictive example, show the following.

DESCRIPTION OF THE PREFERRED EMBODIMENT

Figure 1:
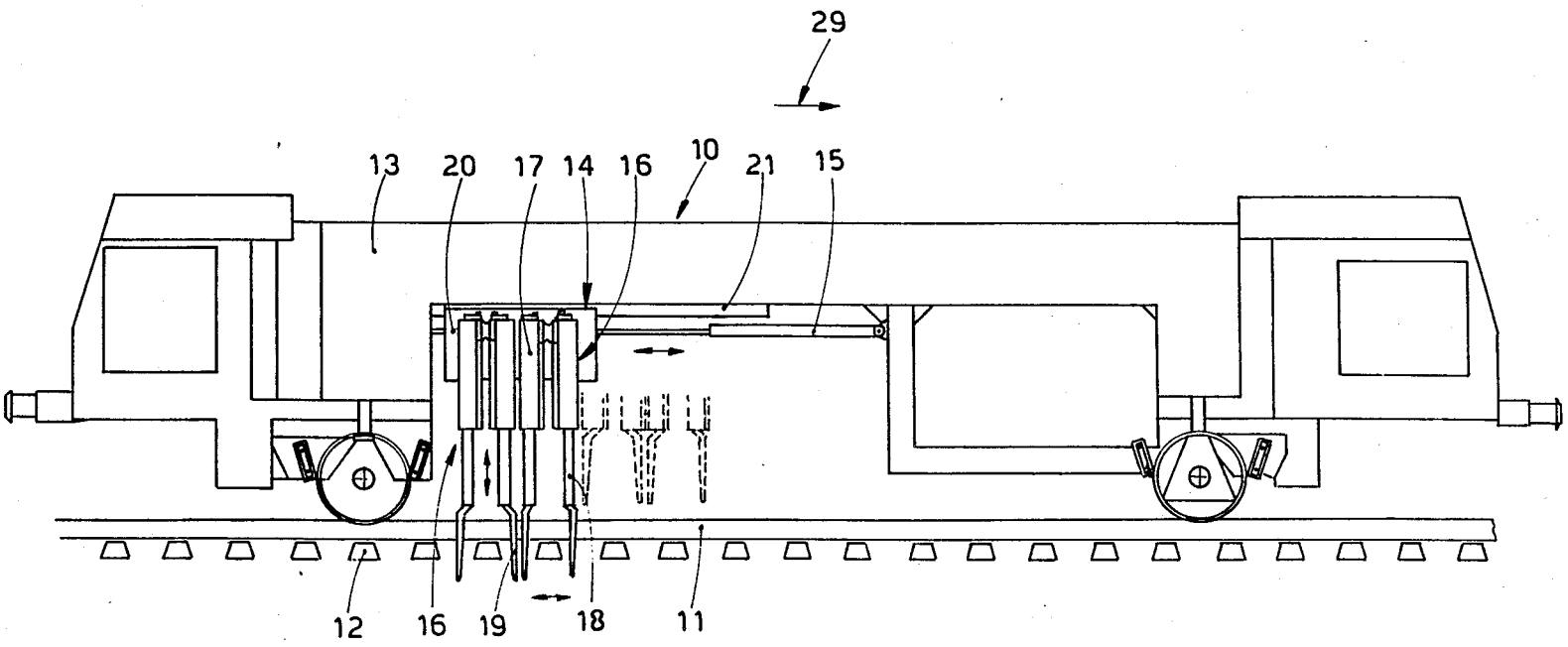
FIG. 1 shows a diagrammatic representation of a ballasttamping machine with a tamping unit comprising independent heads according to the invention.

In FIG. 1 a continuous ballast-tamping machine 10 according to the invention is able to move along a railway line 11 with sleepers 12 in the direction of the arrow 29.

A tamping structure 14 is connected to a structure 13 of the machine and can be moved horizontally by an actuation means 15.

The tamping structure 14 includes independent tamping heads 16, each of which consists of an element 17 to support and guide a tine-holder 18 and tines 19 connected to such holder 18. The tamping structure 14 includes a frame 20 able to slide on slide guides 21.

The tine-holder 18 is able to move vertically within the support and guide element 17 with the hlep of guide rolls 22 owing to the action of a jack 23 connected at 24 to the support and guide element 17.

Figure 2:
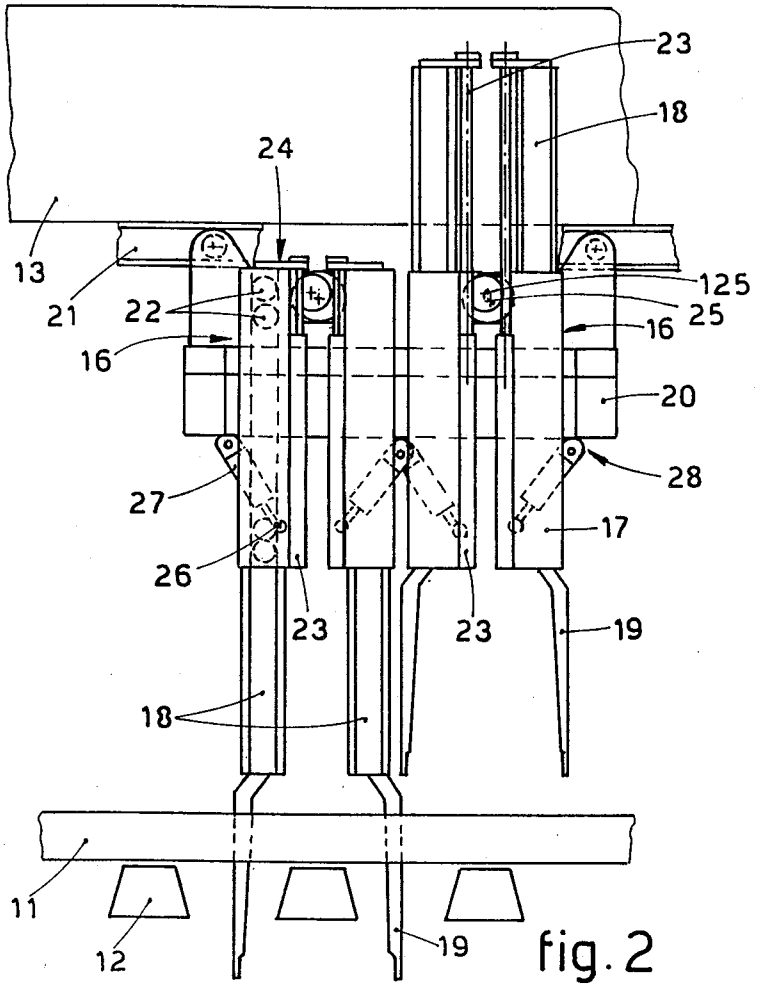
FIG. 2 is a diagrammatic side view of the tamping heads of a tamping unit according to the invention.

FIG. 2 shows two pairs of tamping heads 16 working in series, each pair having heads 16 arranged as counterparts to each other.

The first pair of heads 16 on the lefthand side of FIG. 2 is shown in its position to work on the ballast astride the sleeper 12.

The second pair of heads 16 on the righthand side of FIG. 2 is shown in its inactive position, with the tine-holders 18 and tines 19 raised from the ballast.

Figure 3:
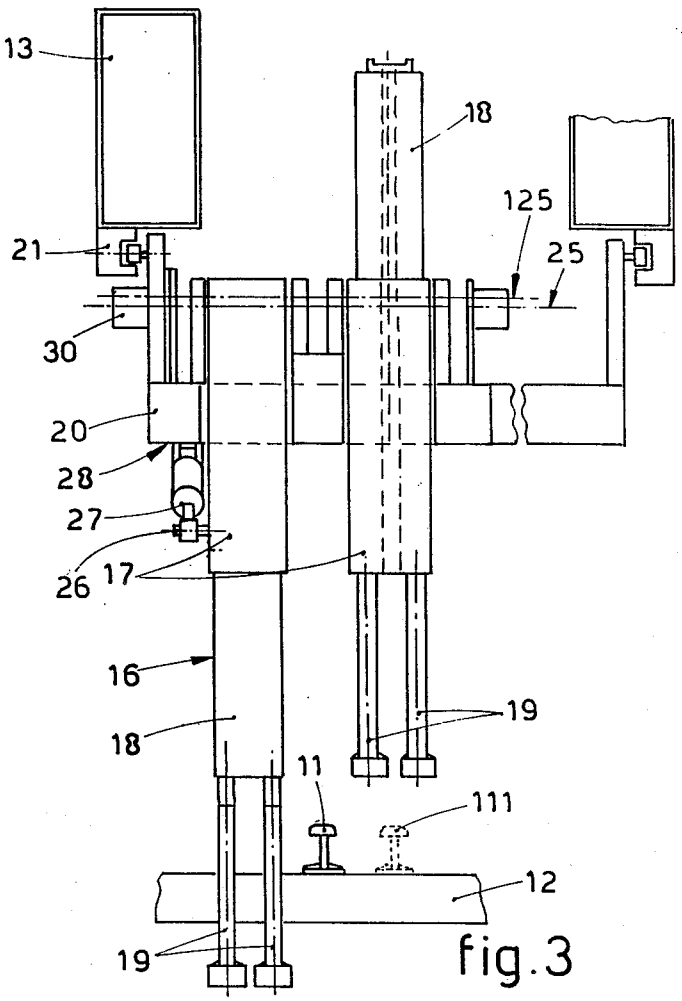
FIG. 3 is a diagrammatic front view of the heads shown in FIG. 1.

FIG. 3 shows two tamping heads 16 working in parallel on the sleeper 12, the lefthand head 16 being shown in a working position on the ballast, whereas the right-hand head 16 is in its inactive position or has been raised to avoid an obstacle.

As an example, each tine-holder 18 bears a pair of tines 19.

The jacks 23 of each head 16 can be actuated independently of each other, as required.

A shaft 25 with cams 125 cooperates with the upper end portion of each support and guide element 17 and is driven by a motor 30, which in rotating imparts vibrations of a desired amplitude and timing to the element 17 and thereby to the tine-holders 18 and tines 19.

Each support and guide element 17 is connected at 26 to a tine projection and retraction element 27, which is advantageously a jack and is connected at 28 to the slidable frame 20.

The jack 27 actuates the support and guide element 17 so as to make the tine 19 approach the sleeper 12 for the action of consolidating the ballast, the tine 19 being caused to vibrate at the same time.

What is claimed is:

1. Continuous ballast-tamping machine which comprises a machine structure able to run with a straight, uniform motion along a railway line, a tamping structure movably connected to said machine structure and adapted to move lengthwise along the machine structure with a straight, alternating movement owing to the action of an actuation means, the tamping structure being for consoidating ballast in accordance with sleepers that bear the railway line, the tamping structure comprising:

a plurality of tamping heads; and independent vibrating means for vibrating pairs of said tamping heads;

wherein each said tamping head comprises a tine-holder, a support and guide element and a vertical actuation means;

wherein said tine-holder is movably connected to said support and guide element;

wherein said tine holder is adapted to move vertically in relation to said support and guide element; and wherein each said tine holder is vertically movable in relation to each said support and guide element by each said vertical actuation means so that each said tine-holder can be positioned vertically in an independent manner in relation to the railway line.

2. Continuous ballast-tamping machine as claimed in claim 1, wherein each said tamping head cooperates with a jack for moving a tine removably mounted to said tine holder toward a sleeper.

3. Continuous ballast-tamping machine as claimed in claim 1, wherein said tamping structure further comprises a slidable frame, and wherein each said support and guide element is solidly fixed to said slidable frame.

4. Continuous ballast-tamping machine as claimed in claim 1, wherein each said tamping head comprises at least one tine rigidly connected to said tine-holder.

5. Continuous ballast-tamping machine which comprises a machine structure able to run with a straight, uniform motion along a railway line, a tamping structure movably connected to said machine structure and adapted to move lengthwise along the machine structure with a straight, alternating movement owing to the action of an actuation means, the tamping structure being for consolidating ballast in correspondence with sleepers that bear the railway line, the tamping structure comprising:

a plurality of tamping heads; and independent vibrating means for vibrating parts of said tamping heads;

wherein each said tamping head comprises a tine-holder, a support and guide element and a vertical actuation means;

wherein said independent vibrating means comprises at least one cam mounted on a shaft which cooperates with upper parts of adjacent pairs of said support and guide elements for providing motion to said plurality of tamping heads;

wherein said tine-holder is movably connected to said support and guide element;

wherein said tine holder is adapted to move vertically in relation to said support and guide element; and wherein each said tine holder is vertically movable in relation to each said support and guide element by each said vertical actuation means so that each said tine-holder can be positioned vertically in an independent manner in relation to the railway line.

6. Continuous ballast-tamping machine as claimed in claim 5, wherein each said tamping head cooperates with a jack for moving a tine removably mounted to said tine holder toward a sleeper.

7. Continuous ballast-tamping machine as claimed in claim 6, wherein said tamping structure further comprises a slidable frame, and wherein each said support and guide element is solidly fixed to said slidable frame by said shaft and said jack.

* * * * *